US006223386B1

(12) United States Patent
Morad

(10) Patent No.: US 6,223,386 B1
(45) Date of Patent: May 1, 2001

(54) APPARATUS FOR CONVERTING A CONVENTIONAL HAND-HELD DUSTPAN INTO A STAND-UP DUSTPAN HAVING AN ELEVATED DEBRIS BARRIER

(75) Inventor: Fred I. Morad, Toluca Lake, CA (US)

(73) Assignee: Worldwide Integrated Resources, Inc., Commerce, CA (US)

( * ) Notice: Subject to any disclaimer, the term of this patent is extended or adjusted under 35 U.S.C. 154(b) by 0 days.

(21) Appl. No.: 09/697,912

(22) Filed: Oct. 26, 2000

(51) Int. Cl.[7] ..... A47L 13/52
(52) U.S. Cl. ..... 15/257.1
(58) Field of Search ..... 15/257.1, 257.2, 15/257.3, 257.4, 257.5, 257.6, 257.7, 257.8, 257.9; 294/55, 56, 59, 115; D32/74

(56) References Cited

U.S. PATENT DOCUMENTS 2,782,615 * 2/1957 Johnson ..... 15/257.1

FOREIGN PATENT DOCUMENTS

290151 * 2/1916 (DE) ..... 15/257.1

* cited by examiner

*Primary Examiner*—Gary K. Graham
(74) *Attorney, Agent, or Firm*—Thomas I. Rozsa; Tony D. Chen; Jerry Fong

(57) ABSTRACT

An apparatus for converting a conventional hand-held dustpan into a stand-up dustpan having a debris barrier to be used by a standing user, including a hand-held dustpan, an upwardly extending handle and a debris barrier. The dustpan has a pan-shaped base member having a rear wall, two sidewalls and an open front scoop over which debris is swept. The scoop is open at the top, and a handle which has two ends affixedly attached to the base member and extends out from the rear wall to form a U-shaped handle. The upwardly extending handle is attached to the U-shaped handle by a clamping member which snaps onto the U-shaped handle with the upwardly extending handle threaded into a threaded bore provided on the clamping member. The debris barrier has three walls which are respectively positioned parallel to the three walls of the pan-shaped base member of the dustpan. A pair of snapping members are provided on the rear wall and snap on top of the U-shaped handle of the dustpan to secure the debris barrier to the pan-shaped base member.

10 Claims, 2 Drawing Sheets

APPARATUS FOR CONVERTING A CONVENTIONAL HAND-HELD DUSTPAN INTO A STAND-UP DUSTPAN HAVING AN ELEVATED DEBRIS BARRIER

BACKGROUND OF THE INVENTION

1. Field of the Invention

The present invention relates generally to the field of hand-held cleaning appliances for manual collection of debris, having a handle attached to a scoop into which debris can be swept for disposal. More particularly, the present invention relates to the field of stand-up dustpans for an upright user to sweep debris conveniently into the dustpan while holding an elongated handle in one hand and a broom in the other hand.

2. Description of the Prior Art

Generally, conventional hand-held dustpans characteristically have a short handle which is rigidly mounted and protrudes from the rear of the dustpan scoop substantially in the same plane as the scoop. The disadvantage with this prior art dustpan is that the user must bend over to grasp the handle and then incline the dustpan at an angle to the floor, to place the edge of the scoop on the floor to gather dust or other debris. In doing so, the user may injure his or her back while bending over to use the hand-held dustpans.

In particular, another prior art dustpan has an elongated handle that protrudes upwardly when the edge of the scoop is placed on the floor, such that the user positions the scoop wilt one hand, in opposition to a broom being manipulated with the other hand. Typically, the handle is rigidly affixed perpendicular to the plane of the scoop of the dustpan and the scoop is open across its top. The closed-rear form of the scoop may swing freely on the handle on a pivot axis near the front of the scoop, such that the rear of the container drops downwardly when the scoop is lifted, capturing the debris. The disadvantage with this prior art this dustpan is that the elongated upwardly extending handle does not come apart. Then the entire dustpan including the handle attached thereon is shipped to retailers. The disadvantage with this is that it is a very cumbersome and expensive way of shipping to the retailers. It would be much easier if the handle can be detached from the dustpan and have the pan-shaped base member with the elongated handle shipped to the retailers detached and then have the elongated handle attached at the site of the retailers.

It is desirable to provide an apparatus for converting a conventional hand-held dustpan into a stand-up dustpan having an elevated debris barrier to be used by a user while standing upright, thereby eliminating the need for a user to bend down to use the dustpan. It is also desirable to provide a stand-up dustpan with the capability of rapidly changing the stand-up dustpan back to a hand-held dustpan.

SUMMARY OF THE INVENTION

The present invention is a novel and unique apparatus for converting a conventional hand-held dustpan into a stand-up dustpan having an elevated debris barrier to be used by a person who is standing upright.

The apparatus comprises a conventional hand-held dustpan, an elongated upwardly extending handle and an elevated debris barrier. The dustpan has a pan-shaped base member having a rear wall, two sidewalls and an open front scoop or blade portion over which debris is scooped or swept. Preferably, the scoop is open at the top, and has a handle member which has two ends affixedly attached to the base member and extends out from the rear wall to form a U-shaped handle. A clamping member snaps onto the U-shaped handle with the upwardly extending handle threaded into a threaded bore that attaches the upwardly extending handle to the U-shaped handle provided on top of the clamping member. The debris barrier comprises three elevated walls which are respectively positioned parallel to the three walls of the pan-shaped base member of the dustpan. A pair of snapping members are provided on the rear wall and snap on top of the U-shaped handle of the dustpan to secure the debris barrier to the pan-shaped base member.

It is an object of the present invention to provide an apparatus for converting a conventional hand-held dustpan into a stand-up dustpan having an elevated debris barrier to be used by a user standing in the upright position, such that a user does not need to bend down to use the dustpan.

It is an additional object of the present invention to provide an apparatus for converting a conventional hand-held dustpan into a stand-up dustpan having an elevated debris barrier to be used by a standing user, thereby eliminating the need for a user to bend down to use the dustpan.

It is a further object of the present invention to provide a stand-up dustpan with the capability of rapidly changing the stand-up dustpan to a hand-held dustpan and vice versa.

It is another object of the present invention to provide an apparatus for converting a conventional hand-held dustpan into a stand-up dustpan having an elevated debris barrier that is durable, inexpensive, and easy to merchandise, display, transport, store and use.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
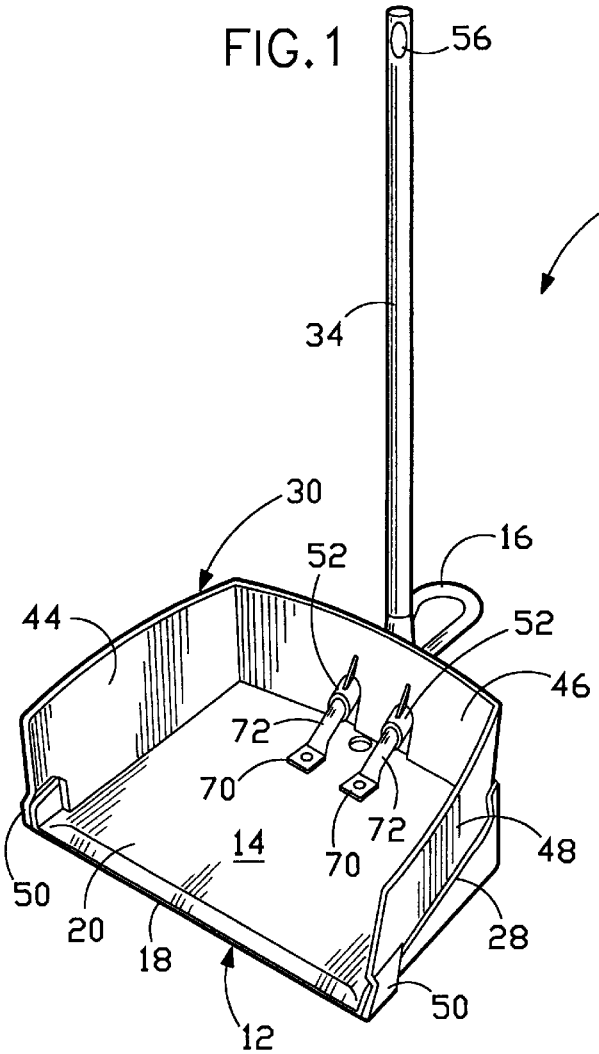
FIG. 1 is a perspective view of the present invention apparatus for converting a conventional hand-held dustpan into a stand-up dustpan having an elevated debris barrier to be used by a user while in the standing position.
Figure 2:
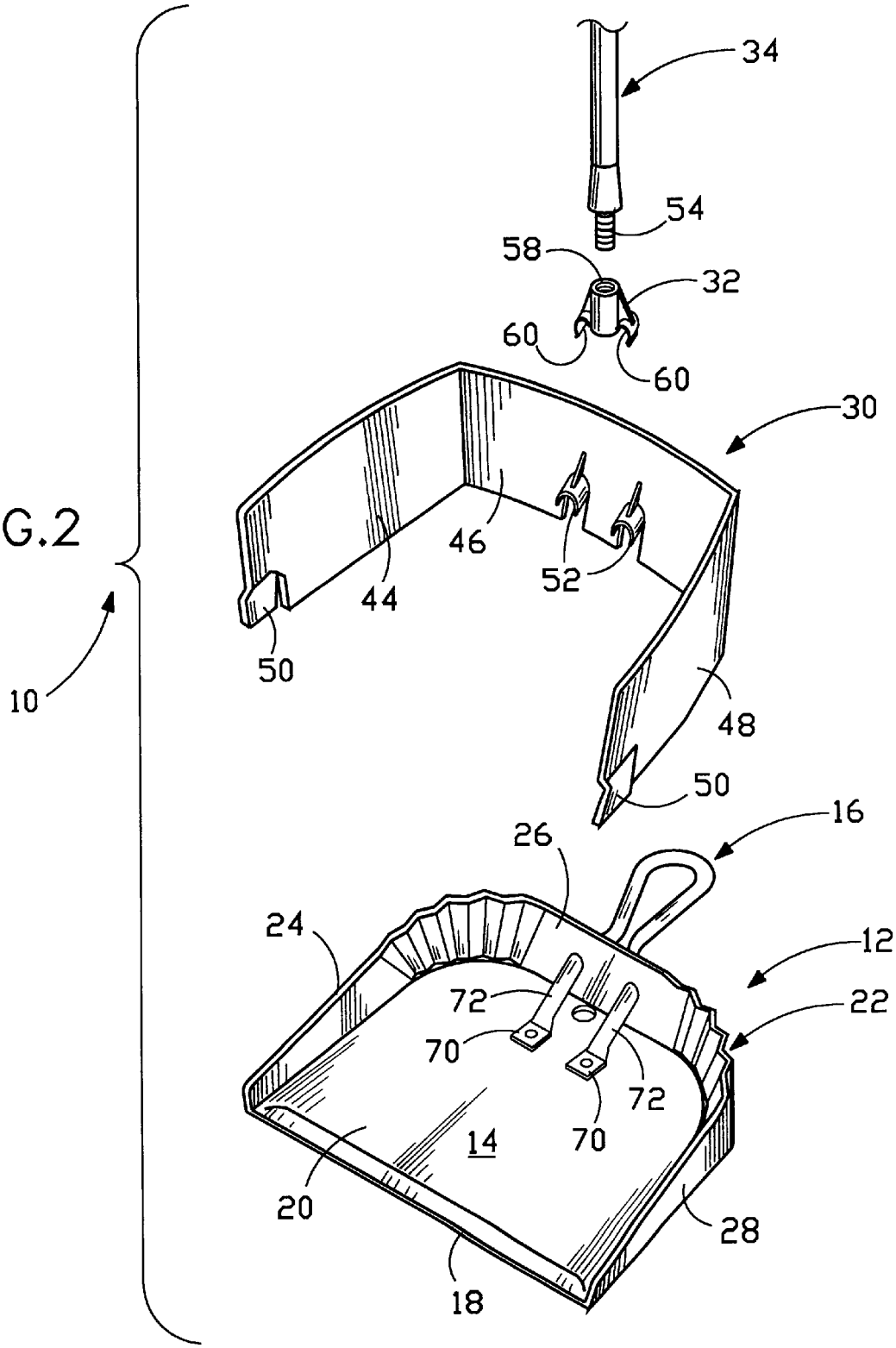
FIG. 2 is an exploded perspective view of the present invention apparatus.

Referring to FIGS. 1 and 2, there is shown at 10 an apparatus for converting a conventional hand-held dustpan 12 into a stand-up dustpan 10 to be used by a user while standing. An exemplary embodiment of the conventional dustpan construction 12 according to the present invention is shown generally in FIGS. 1, 2 and 3. The present invention apparatus 10 comprises a conventional hand-held dustpan 12, an elevated debris barrier 30, a mounting bracket 32, and an elongated upwardly extending handle 34.

The dustpan 12 comprises a pan-shaped scoop or base member 14 and a handle member which is substantially parallel to the base member 14, whereby the base member 14 and the handle member 16 are operatively connected. The hand-held dustpan 12 is operated in a known manner by a user bending down and holding the handle member 16 in one hand and a broom (not shown) in the other hand. The user urges debris over an edge or blade 18 of the scoop 14, collecting the debris on the upper surface 20 until it is convenient to dump the debris.

Figure 3:
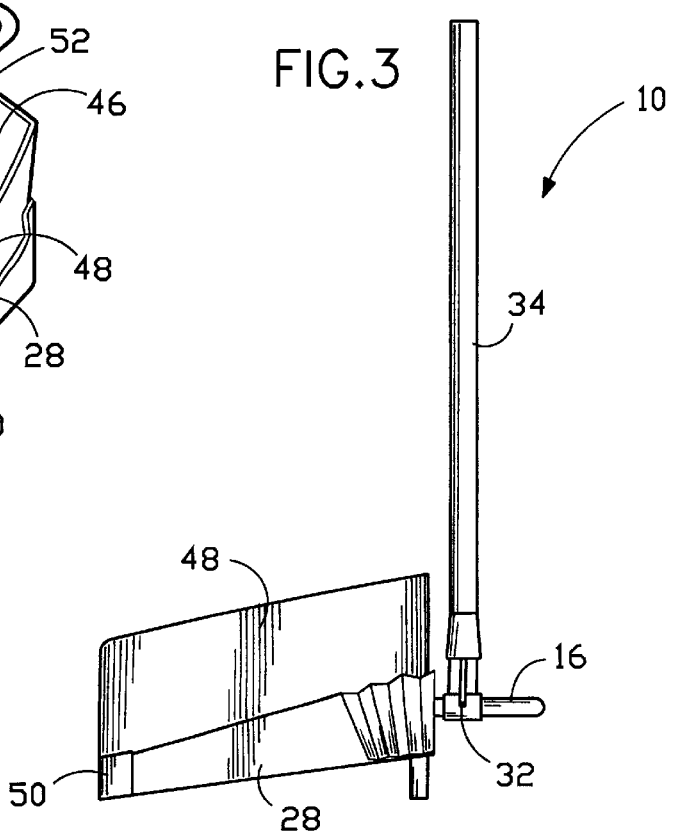
FIG. 3 is a side elevational view of the present invention apparatus.

Referring to FIGS. 1, 2 and 3, the pan-shaped base member 14 has a generally planar body that extends laterally from the longitudinal axis of the handle member 16 and has an open top. The base member 14 has an upper surface 20 leading to an open front scoop or blade portion 18. A low profile debris barrier 22 has three shallow perpendicular walls 24, 26 and 28 integrally formed with each other and extend upwardly from and around three side edges of the surface 20, forming a walled enclosure for confining debris within the partially enclosed base member 14. The debris is confined so long as the dustpan 12 is not tilted forward or tilted in another direction sufficient to allow the debris to pass over one of the walls.

The base member 14 of the dustpan 12 has a lateral width of convenient size to collect debris therein, for example being slightly wider than the broom with which it is used. The base member 14 has a length from front to rear of a suitable size to contain a substantial amount of gathered debris. The open front scoop portion 18 is configured for easy flow of debris over the scoop 14 and into the dustpan 12 when placed on a horizontal surface, such as a floor. The open front scoop portion 18 may be tapered at its terminal edge to define a ramp or incline such that debris may be swept from a horizontal surface, such as a floor, into the base member 14 of the dustpan 12 more efficiently. The surface 20 may also be tapered or inclined downward from the front to rear, defining a well which retains the gathered debris accumulated in the base member as the dustpan 12 is carried around. The dustpan 12 can be molded of plastic material such as polyethylene or polypropylene. The dustpan 12 is preferably of lightweight construction, and alternatively can be made of sheet metal or other suitable material.

The handle member 16 is tubular and forms into a U-shaped body, where the ends 70 are spaced apart and extend into the rear wall 26 and are permanently affixed to the base member 14 by conventional means.

The elevated debris barrier 30 has three elevated perpendicular walls 44, 46 and 48 integrally formed with each other and extend upwardly therefrom. The debris barrier 30 comprises a pair of spaced apart clamping members 52 which protrude from the interior of the rear wall 46 for clamping on the inner portion of the legs or tubes 72 of the handle member 16 of the dustpan 12. The debris barrier 30 further has a front split portion 50 located on each of the walls 44 and 48. The debris barrier 30 is installed on the dustpan 12 such that the three elevated walls 44, 46 and 48 are respectively positioned parallel to the walls 24, 26 and 28 of the dustpan 12. Furthermore, the front split portions 50 when secured to respective walls assist in aligning the debris barrier 30 to the dustpan 12. The debris barrier 30 further assists in confining the debris within the base member 14.

The elongated upwardly extending handle 34 is long enough to allow a user to use the dustpan apparatus 10 in an upright position. The handle 34 can be solid or hollow. The handle 34 has screw threads 54 near its proximal end and is threadedly connected to the mounting bracket 32. The handle 34 may include a hook or through hole 56 (see FIG. 1) near its distal end for hanging the dustpan apparatus 10 during storage or display.

The mounting bracket 32 has an upper threaded bore 58 and two curved arm surfaces 60 for respectively snapping onto the outer portion of the tube legs 72 which form the dustpan handle member 16. The two curved arm surfaces 60 fit over the two tube legs 72 of the dustpan handle member 16 as shown in FIG. 3. Once the mounting bracket 32 is installed, the elongated upwardly extending handle 34 is threadedly engaged with the threaded bore 58 of the mounting bracket 32 to form the stand-up dustpan apparatus 10 such that the upwardly extending handle 34 is in a perpendicular position relative to the base member 14.

The present invention conforms to conventional forms of manufacture or any other conventional way known to one skilled in the art, and is of simple construction and is easy to use. The present invention apparatus can be made from several materials. By way of example, the dustpan apparatus 10 can be made of plastic material, sheet metal material or any other suitable material known in the art.

Defined in detail, the present invention is an apparatus for converting a hand-held dustpan into a stand-up dustpan to be used by a user in the standing position, the hand-held dustpan having a pan-shaped base member with an upper surface leading to an open front scoop portion and three shallow perpendicular walls integrally formed with each other and extending upwardly from and around three side edges of the surface and forming a walled enclosure for confining debris within the partially enclosed base member, and a horizontal U-shaped handle having a pair of legs in a substantially parallel relationship with the base member and extending outwardly from one of the three shallow walls, whereby the base member and the U-shaped handle are operatively connected, the apparatus comprising: (a) a debris barrier having three elevated perpendicular walls integrally formed with each other and a pair of spaced apart clamping members protruding inwardly from one of the three elevated walls, the debris barrier positioned around the inner perimeter of the pan-shaped base member and respectively in engagement with a respective one of the three shallow walls of the base member such that the pair of clamping members snap onto the inner portion of legs of the U-shaped handle to secure the debris barrier thereto, and a respective two walls of the three elevated walls each having a split portion for securing to a respective two of the three shallow walls of the base member; (b) a mounting bracket having a threaded bore and two curved arm surfaces for respectively securing and snapping onto the outer portion of the legs of the U-shaped handle of the hand-held dustpan; and (c) an elongated upwardly extending handle having outer screw threads at its proximal end and threadedly engaged with the threaded bore of the mounting bracket to form the stand-up dustpan such that the upwardly extending handle is in a perpendicular positioned relative to the base member; (d) whereby the apparatus for converting the hand-held dustpan into the stand-up dustpan to be used by a user standing upright, such that the user does not need to bend down to use the stand-up dustpan.

Defined broadly, the present invention is an apparatus for converting a hand-held dustpan into a stand-up dustpan to be used by a user in the standing position, the hand-held dustpan having a base member with a surface leading to an open front scoop portion and three shallow walls and extending upwardly from and around three side edges of the surface and forming a walled enclosure for confining debris within the partially enclosed base member, and a U-shaped handle in a substantially parallel relationship with the base member and extending outwardly from one of the three shallow walls, the U-shaped member having a pair of legs extending through the wall, whereby the base member and the U-shaped handle are operatively connected, the apparatus comprising: (a) a debris barrier having three elevated walls and at least two clamping members protruding inwardly from one of the three elevated walls, the debris barrier positioned around the inner perimeter of the base member and respectively in engagement with a respective one of the three shallow walls of the base member such that the at least two clamping members snap onto the inner portion of legs of the U-shaped handle to secure the debris barrier thereto, and a respective two elevated walls of the debris barrier each having a split portion for securing to a respective two of the three shallow walls of the base member; (b) a mounting bracket having a threaded bore and at least two curved arm surfaces for respectively securing and snapping onto the outer portion of the legs of the U-shaped handle of the dustpan; and (c) an upwardly extending handle having screw threads at its proximal end and threadedly engaged with the threaded bore of the mounting bracket to form the stand-up dustpan; (d) whereby the apparatus for converting the hand-held dustpan into the stand-up dustpan to be used by the standing user, such that the user does not need to bend down to use the stand-up dustpan.

Defined more broadly, the present invention is an apparatus for converting a hand-held dustpan into a stand-up dustpan to be used by a user in the standing position, the hand-held dustpan having a base member with a surface and three shallow walls extending upwardly from and around three side edges of the surface and forming a walled enclosure for confining debris within the partially enclosed base member, and a handle member in a substantially parallel relationship to the base member and extending outwardly from one of the three shallow walls, whereby the base member and the handle member are operatively connected, the apparatus comprising: (a) a debris barrier having three elevated walls positioned around the inner perimeter of the base member and respectively in engagement with a respective one of the three shallow walls of the base member, the debris barrier having means for securing the debris barrier to the base member of the hand-held dustpan; (b) mounting means detachably attached to the handle member of the hand-held dustpan; and (c) an elongated handle having means for detachably attaching to the mounting means such that the elongated handle is positioned perpendicular to the handle member of the hand-held dustpan; (d) whereby the apparatus for converting the hand-held dustpan into the stand-up dustpan is to be used by said standing user, such that the user does riot need to bend down to use the stand-up dustpan.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing fill public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. An apparatus for converting a hand-held dustpan into a stand-up dustpan to be used by a user in the standing position, the hand-held dustpan having a pan-shaped base member with an upper surface leading to an open front scoop portion and three shallow perpendicular walls integrally formed with each other and extending upwardly from and around three side edges of the surface and forming a walled enclosure for confining debris within the partially enclosed base member, and a horizontal U-shaped handle having a pair of legs in a substantially parallel relationship with the base member and extending outwardly from one of the three shallow walls, whereby the base member and the U-shaped handle are operatively connected, the apparatus comprising:

a. a debris barrier having three elevated perpendicular walls integrally formed with each other and a pair of spaced apart clamping members protruding inwardly from one of the three elevated walls, the debris barrier positioned around the inner perimeter of said pan-shaped base member and respectively in engagement with a respective one of said three shallow walls of said base member such that the pair of clamping members snap onto the inner portion of legs of said U-shaped handle to secure the debris barrier thereto, and a respective two walls of the three elevated walls each having a split portion for securing to a respective two of said three shallow walls of said base member;

b. a mounting bracket having a threaded bore and two curved arm surfaces for respectively securing and snapping onto the outer portion of said legs of said U-shaped handle of said hand-held dustpan; and c. an elongated upwardly extending handle having outer screw threads at its proximal end and threadedly engaged with said threaded bore of said mounting bracket to form said stand-up dustpan such that the upwardly extending handle is in a perpendicular positioned relative to said base member;

d. whereby said apparatus for converting said hand-held dustpan into said stand-up dustpan to be used by said user standing upright, such that said user does not need to bend down to use said stand-up dustpan.

2. The apparatus in accordance with claim 1, wherein said elongated upwardly extending handle further comprises a through hole at its distal end for hanging said stand-up dustpan during storage or display.

3. An apparatus for converting a hand-held dustpan into a stand-up dustpan to be used by a user in the standing position, the hand-held dustpan having a base member with a surface leading to an open front scoop portion and three shallow walls and extending upwardly from and around three side edges of the surface and forming a walled enclosure for confining debris within the partially enclosed base member, and a U-shaped handle in a substantially parallel relationship with the base member and extending outwardly from one of the three shallow walls, the U-shaped member having a pair of legs extending through the wall, whereby the base member and the U-shaped handle are operatively connected, the apparatus comprising:

a. a debris barrier having three elevated walls and at least two clamping members protruding inwardly from one of the three elevated walls, the debris barrier positioned around the inner perimeter of said base member and respectively in engagement with a respective one of said three shallow walls of said base member such that the at least two clamping members snap onto the inner portion of legs of said U-shaped handle to secure the debris barrier thereto, and a respective two elevated walls of the debris barrier each having a split portion for securing to a respective two of said three shallow walls of said base member;

b. a mounting bracket having a threaded bore and at least two curved arm surfaces for respectively securing and snapping onto the outer portion of said legs of said U-shaped handle of said dustpan; and c. an upwardly extending handle having screw threads at its proximal end and threadedly engaged with said threaded bore of said mounting bracket to form said stand-up dustpan;

d. whereby said apparatus for converting said hand-held dustpan into said stand-up dustpan to be used by said standing user, such that said user does not need to bend down to use said stand-up dustpan.

4. The apparatus in accordance with claim 3, wherein said upwardly extending handle further comprises a through hole at its distal end for hanging said stand-up dustpan during storage or display.

5. An apparatus for converting a hand-held dustpan into a stand-up dustpan to be used by at user in the standing position, the hand-held dustpan having a base member with a surface and three shallow walls extending upwardly from and around three side edges of the surface and forming a walled enclosure for confining debris within the partially enclosed base member, and a handle member in a substantially parallel relationship to the base member and extending outwardly from one of the three shallow walls, whereby the base member and the handle member are operatively connected, the apparatus comprising:

a. a debris barrier having three elevated walls positioned around the inner perimeter of said base member and respectively in engagement with a respective one of said three shallow walls of said base member, the debris barrier having means for securing the debris barrier to said base member of said hand-held dustpan;

b. mounting means detachably attached to said handle member of said hand-held dustpan; and c. an elongated handle having means for detachably attaching to said mounting means such that the elongated handle is positioned perpendicular to said handle member of said hand-held dustpan;

d. whereby said apparatus for converting said hand-held dustpan into said stand-up dustpan is to be used by said standing user, such that said user does not need to bend down to use said stand-up dustpan.

6. The apparatus in accordance with claim 5, wherein said elongated handle further comprises a through hole at its distal end for hanging said stand-up dustpan during storage or display.

7. The apparatus in accordance with claim 5, wherein said three elevated walls of said debris barrier are integrally formed.

8. The apparatus in accordance with claim 5, wherein said mounting means includes a threaded bore and two curved and surfaces for respectively securing and attaching to said handle member of said hand-held dustpan.

9. The apparatus in accordance with claim 5, wherein said means for securing said debris barrier to said base member of said hand-held dustpan includes at least one clamping member protruding inwardly from one of said three elevated walls for attaching to said handle member of said hand-held dustpan.

10. The apparatus in accordance with claim 5, wherein a respective two of said three elevated walls of said debris barrier each having a split portion for securing to a respective two of said three shallow walls of said base member.

* * * * *